United States Patent [19]

Gartner

[11] Patent Number: 4,537,000

[45] Date of Patent: Aug. 27, 1985

[54] THERMAL INSULATING WINDOW FOR APPLICATION IN CURTAIN WALLS

[75] Inventor: Karl Gartner, Gundelfingen, Fed. Rep. of Germany

[73] Assignee: Yoshida Kogyo K. K., Tokyo, Japan

[21] Appl. No.: 517,007

[22] Filed: Jul. 25, 1983

[30] Foreign Application Priority Data

Jul. 26, 1982 [JP] Japan ..... 57-113264[U]

[51] Int. Cl.[3] ..... E06B 1/32; E06B 1/22

[52] U.S. Cl. ..... 52/235

[58] Field of Search ..... 52/235, 403, 208; 49/DIG. 1, 504, 401, 400, 402, 403, 404

[56] References Cited

U.S. PATENT DOCUMENTS

| | | | |
|---|---|---|---|
| 3,072,229 | 1/1963 | Pasche | 49/401 |
| 3,557,514 | 1/1971 | Fahrni | 49/504 |
| 4,084,361 | 4/1978 | Aspaas | 49/DIG. 1 |
| 4,314,424 | 2/1982 | Gordon | 49/DIG. 1 |
| 4,344,254 | 8/1982 | Varlonga | 49/504 |

FOREIGN PATENT DOCUMENTS

| | | | |
|---|---|---|---|
| 2904295 | 8/1979 | Fed. Rep. of Germany | 49/DIG. 1 |

*Primary Examiner*—John E. Murtagh

*Attorney, Agent, or Firm*—Hill, Van Santen, Steadman & Simpson

[57] ABSTRACT

A thermal insulating window comprising a thermal insulating window framework having internal framework members supported adiabatically by a thermal insulating curtain wall and external framework members connected thereto through thermal insulating members; and a window body having a window casing mounted to the thermal insulating window framework capable of opening and closing and a panel member supported on the window casing at its periphery. The window further includes a sealing member made of thermal insulating material which is adapted to cover the whole of the outer surface of the window casing and to be in contact with the outer and upper portion of the external framework member. A thermal insulating area is provided at the junction of the window casing and the panel member and a thermal insulating space defined between the window casing and the thermal insulating window framework so that thermal insulation between the inner and outer sides of curtain walls is achieved.

In the thermal insulating window, all heat transfer passages between the inner and outer sides of the curtain walls pass through one or more thermal insulating material or thermal insulating space, and therefore the thermal insulating window has a high thermal insulating efficiency as a whole.

2 Claims, 3 Drawing Figures

THERMAL INSULATING WINDOW FOR APPLICATION IN CURTAIN WALLS

BACKGROUND OF THE INVENTION

The present invention relates to a thermal insulating window for curtain walls in which the heat insulation characteristics thereof are not lowered as a whole.

The heat insulation capacity of a curtain wall has a considerable effect on the efficiency of air conditioning. In effect, in some building structures where the room has a window, the ability of the walls to ensure thermal insulation for the room is largely dependent on the structure of the window. Consequently, high demand has been placed on the development of an effective thermal insulating window of a design or structure that enables the window to be constructed into the wall of the room without diminishing the heat insulation capacity of the wall as well as the room as a whole.

German Patent Public Disclosure No. 2855022 is the closest prior art to the present invention. FIG. 3 is a horizontal cross sectional view of the heat insulating window for a curtain wall in accordance with the above German Patent Public Disclosure No. 2855022. The heat insulating window "a" adiabatically mounted to a column member "a" of the building generally comprises a thermal insulating window "b", thermal insulating window framework "c" inserted and fixed to the vertical member "a" and a window body "d" mounted to the thermal insulating window framework capable of opening and closing. The thermal insulating window framework "c" comprises an internal framework member "e" secured to the room side member of the vertical member of the building and external framework member "g" connected to the internal framework member "e" by means of a pair of thermal insulating members "f", "f". On the other hand, the thermal insulating window body "d" comprises an internal window casing "h" mounted to the internal framework member and capable of opening and closing, and an external window casing connected to the internal window casing through a pair of thermal insulating members "i", "i". A sealing member "k" is provided between the insulating thermal window framework "c" and the window body "d" so that a thermal insulating space is defined therebetween.

Therefore, in the conventional thermal insulating window, thermal insulation at the thermal insulating window itself and the space between the thermal insulating window framework "c" and window body "d" is efficiently carried out through one or more of the thermal insulating members or thermal insulating space. However, this conventional thermal insulating window has some disadvantage in that thermal insulation of the window body itself, particularly at the junction of the glass and window casing is not sufficient. Thus, in the conventional thermal insulating window a large quantity of heat can be transferred through the window casing because the outside portion of the internal window casing is in contact with a batten "l" which is open to outdoor air. This construction leads to poor thermal insulation at this point. Further, the external window casing in the conventional thermal insulating window connected to the internal window casing through the paired of the thermal insulating members "i", "i" does not function sufficiently as a thermal insulating member so that the total cost for manufacturing the thermal insulating window is increased in proportion to the increased members.

SUMMARY OF THE INVENTION

Therefore, the primary object of the present invention is to provide a thermal insulating window for application in curtain walls with high efficiency in thermal insulation.

Another object of the present invention is to provide a thermal insulating window for application in curtain walls with low manufacturing cost.

Still another object of the present invention is to provide a thermal insulating window for application in curtain walls with high constructional strength at the area of the thermal insulating window.

Therefore, the present invention relates to a thermal insulating window for application in curtain walls in which outer side skeleton members are connected to room side skeleton members of framed vertical members and horizontal members by means of thermal insulating members, said window comprising, a thermal insulating window framework having internal framework members supported by the room side skeleton members of the curtain walls and external framework members connected to the internal framework members through thermal insulating members; and a window body having window casing mounted to the internal framework members of the thermal insulating window framework capable of opening and closing and a panel member supported at its periphery on the window casing;

said window being characterized in that it further includes a sealing member consisting of a thermal insulating member which is adapted to cover the whole of the outer surface of the window casing and to be in contact with the outer upper portion of the external framework member whereby a thermal insulating area is provided at the junction of the window casing and the panel member and a thermal insulating space is defined between the thermal insulating window framework and the window body.

In the preferred form of the present invention, the thermal insulating window includes a second sealing member extending so as to be in contact with the thermal insulating member which connects the internal framework members to the external framework members and with the sealing member covering the window casing, thereby dividing the thermal insulating space between the thermal insulating window framework and the window body into two compartments. This brings more effective thermal insulation between the thermal insulating window framework and the window body.

In the further preferred form of the present invention, the panel member supported by the window casing comprises paired glass having a thermal insulating space incorporated therein which results in additionally effective thermal insulation through the glass itself.

BRIEF DESCRIPTION OF THE DRAWINGS

The invention will now be described in more detail with reference to the drawings in which like reference numerals are used for the same parts as shown in different figures.

DESCRIPTION OF THE PREFERRED EMBODIMENT

The present invention has been proposed to provide a thermal insulating window design that meets the needs outlined above. The present invention will hereinunder be described in full detail in conjunction with the accompanying drawings, showing its preferred embodiment.

Figure 1:
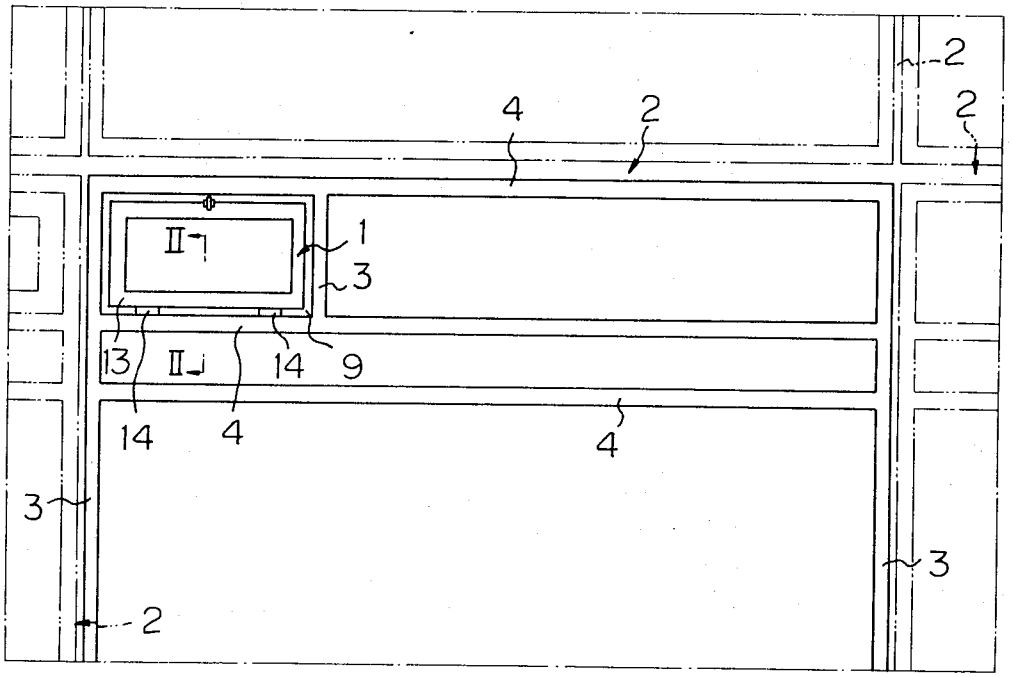
FIG. 1 is a front elevational view of a unit curtain wall as seen from the room side showing the thermal insulating window in accordance with the present invention mounted therein.

FIG. 1 is a front elevational view of a unit curtain wall as seen from the room side showing the thermal insulating window in accordance with the present invention mounted therein. Each of the unit curtain walls 2 is assembled by securing an external skeleton member constituting a batten 5 to an internal skeleton member of four-sides consisting of vertical members 3 and horizontal members 4 with thermal insulating material therebetween.

Figure 2:
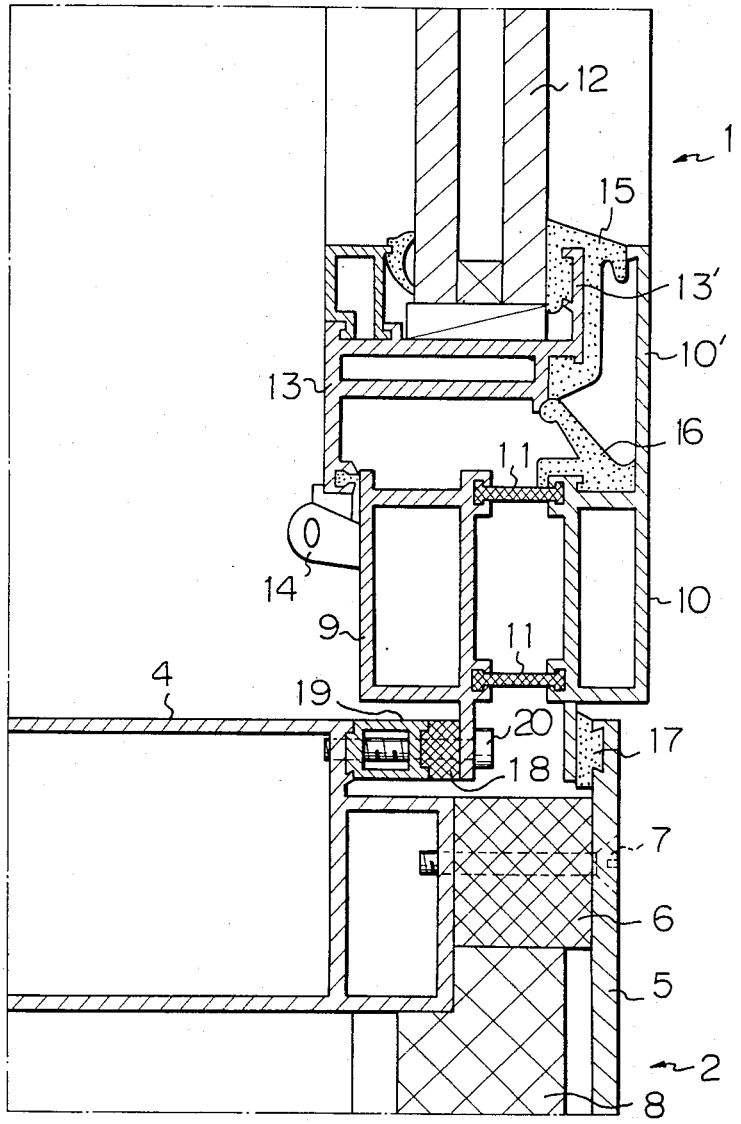
FIG. 2 is a cross sectional view of the thermal insulating window in accordance with the present invention taken along line II—II of FIG. 1.
Figure 3:
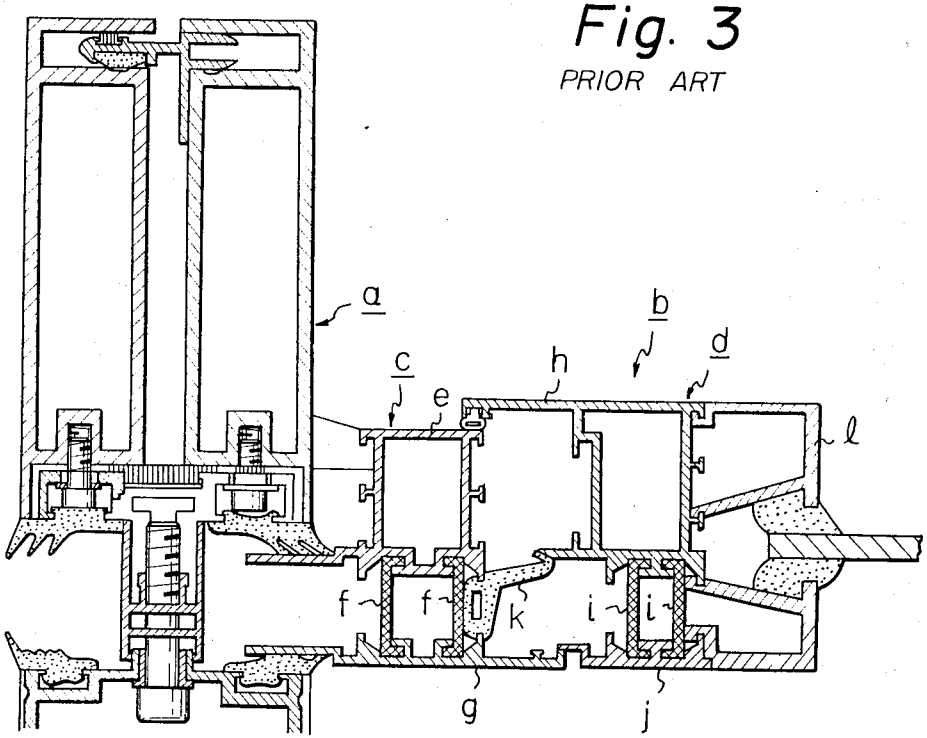
Fig. 3 PRIOR ART
FIG. 3 is a horizontal cross sectional view of the thermal insulating window in accordance with the prior art.

FIG. 2 is a cross sectional view taken along the line II—II of FIG. 1 showing the area where the thermal insulating window is mounted in the unit curtain wall 2. In the preferred embodiment shown, the thermal insulating window is of the type which can be opened by tilting it inwardly towards the room. This thermal insulating window is of the type in which window casing 13 being four-sided and comprising stiles and rails is mounted to a thermal insulating window framework of four-sided framework members having the same cross sections. In FIG. 2, only one of the four-sides is shown.

Although in the preferred embodiment the lower rail is mounted to the lower internal framework member 9 of the window framework, in the case of a revolving window or pull open window, the window casing 13 is attached to the window framework at other places.

As described above, in the unit curtain wall 2 a sheet member 8 is made of insulating material and another thermal insulating material in block or belt-like configuration is interposed between the four-sided internal skeleton members consisting of horizontal members 4 and the battens 5 constituting the external skeleton members, with screws 7 securing them together to provide a thermal insulating curtain wall. The vertical members 3 and the horizontal members 4 may be formed with hollow members so as to define an air or heat transfer medium passage such that the curtain wall itself provides an air conditioning surface by circulating water or air constituting a heat transfer medium through said passage.

The thermal insulating window framework consists of separate internal framework members 9 and external framework members 10, the internal framework members 9 and the external framework members 10 being connected to each other by means of connecting members 11 made of strengthened thermal insulating material to provide a heat insulating window. The strengthened thermal insulating material of the connecting members 11 may be urethane foam or styrofoam. In this particular embodiment, paired glass having a thermal insulating space incorporated therein to provide high thermal insulation effect is used. The lower rail of the window casing 13 is connected to the lower internal framework member 9 through hinge 14 so that the window casing 13 can be tilted in relation to the window framework so as to open the window on the room side. The window casing 13 is provided with an outer vertical flange 13′ on the side opposite to the room thereof. The whole of the outer surfaces of the outer vertical flange 13′ is covered by sealing member 15 which serves as a thermal insulating material for the same. The sealing member 15 is adapted to be in contact with the outer side glass of the paired glass 12 as well as with the vertical extension 10′ of the external framework member 10 so that a thermal insulating space is defined between the thermal insulating window framework and the window casing 13. The second sealing member 16 may be located at the junction of the external framework member 10 and the strengthened connecting members 11 so as to come into contact with the first sealing member 15. The thermal insulating space is defined by the vertical extension 10′, the first sealing member 15 and the second sealing member 16 which is divided into two compartments to provide further thermal insulation. The connection between the thermal insulating window detailed heretofore and the unit curtain wall 2 is accomplished by screws 20 extending through the internal framework member 9 and the horizontal member 4 (vertical member 3 in the case of the stile) of the unit curtain wall. On the external side of the unit curtain wall 2, the batten 5 is provided with sealing member 17 for contact with the external framework member 10. Therefore, the periphery of the window framework is sealed in position by the batten 5 and the horizontal member 4. This maintains the thermal insulating construction between the inner and outer sides of the room formed at the area of the thermal insulating window and the unit curtain walls 2 so that the thermal insulating line along the curtain wall is not destroyed in any direction.

In the embodiment explained above, description is confined to the structure of a window that is tilted inwardly towards the room to open. However, it should be understood that this invention is applicable to other structures of thermal insulating windows. The paired glass 12 is only a matter of choice, and a single glass sheet or other forms of panel member may be used. Furthermore, the attachment means 19 securing the internal framework member 9 to the horizontal member 4 may be provided at its end with a thermal insulating member 18.

It will be appreciated from the above description that the thermal insulating window of the present invention is capable of installation into a thermal insulating curtain wall which comprises room side skeleton members of vertical and horizontal members and outer side skeleton members connected therewith through heat insulating material, without affecting the original thermal insulation capacity of the wall. Consequently, the wall can provide increased thermal insulation for the room without diminishing the efficiency of air conditioning.

Further, since the present window casing of the window body is made from integral members without use of connecting members, it has sufficient strength to support comparatively heavy paired glass.

What is claimed is:

1. A thermal insulating window for application in curtain walls in which outer side skeleton members are connected to room side skeleton members of framed vertical members and horizontal members by means of thermal insulating members, said window comprising, a thermal insulating window framework having internal framework members supported by the room side skeleton members of the curtain walls and external framework members connected to the internal framework members through thermal insulating members; and a window body having a window casing mounted to the internal framework members of the thermal insulating window framework capable of opening and closing and a panel member supported at its periphery on the window casing;

said window being characterized in that it further includes a first sealing member consisting of a thermal insulating member which is adapted to cover the whole of the outer surface of the window casing and to be in contact with the outer upper portion of the external framework member whereby a thermal insulating area is provided at the junction of the window casing and the panel member and a thermal insulating space is defined between the thermal insulating window framework and the window body and a second sealing member extends so as to be in contact at one end with the thermal insulating member which connects the internal framework members to the external framework members and at another end with the first sealing member and the window casing, thereby dividing the thermal insulating space between the thermal insulating window framework and the window body into two consecutive compartments disposed between outer and room side skeleton members.

2. A thermal insulating window according to claim 1 wherein said panel member comprises paired glass having a thermal insulating space incorporated therein.

* * * * *